US006954601B2

(12) United States Patent
Numagami et al.

(10) Patent No.: US 6,954,601 B2
(45) Date of Patent: Oct. 11, 2005

(54) PROCESS CARTRIDGE AND ELECTROPHOTOGRAPHIC IMAGE FORMING APPARATUS

(75) Inventors: Atsushi Numagami, Kanagawa (JP); Akiyoshi Fujita, Shizuoka (JP); Takahito Ueno, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/671,521

(22) Filed: Sep. 29, 2003

(65) Prior Publication Data

US 2004/0131379 A1 Jul. 8, 2004

(30) Foreign Application Priority Data

Sep. 30, 2002 (JP) ..... 2002-287440

(51) Int. Cl.[7] ..... G03G 15/00
(52) U.S. Cl. ..... 399/90; 399/107; 399/111
(58) Field of Search ..... 399/75, 90, 107, 399/111

(56) References Cited

U.S. PATENT DOCUMENTS

| | | | | |
|---|---|---|---|---|
| 5,283,616 | A | 2/1994 | Numagami et al. | 355/245 |
| 5,383,011 | A | 1/1995 | Numagami et al. | 355/298 |
| 5,500,714 | A | 3/1996 | Yashiro et al. | 355/200 |
| 5,543,898 | A | 8/1996 | Shishido et al. | 355/210 |
| 5,585,895 | A | 12/1996 | Yashiro et al. | 355/215 |
| 5,617,579 | A | 4/1997 | Yashiro et al. | 399/114 |
| 5,689,774 | A | 11/1997 | Shishido et al. | 399/111 |
| 5,768,658 | A | 6/1998 | Watanabe et al. | 399/111 |
| 5,790,923 | A | 8/1998 | Oguma et al. | 399/106 |
| 5,907,751 | A * | 5/1999 | Kawaguchi et al. | 399/117 |
| 5,920,753 | A | 7/1999 | Sasaki et al. | 399/111 |
| 5,937,239 | A | 8/1999 | Watanabe et al. | 399/111 |
| 5,937,242 | A | 8/1999 | Yokoyama et al. | 399/114 |
| 5,963,759 | A | 10/1999 | Kojima et al. | 399/111 |
| 5,966,566 | A | 10/1999 | Odagawa et al. | 399/109 |
| 5,966,568 | A | 10/1999 | Numagami et al. | 399/111 |
| 6,006,058 | A | 12/1999 | Watanabe et al. | 399/111 |
| 6,016,413 | A | 1/2000 | Yokoyama et al. | 399/113 |
| 6,029,032 | A | 2/2000 | Watanabe et al. | 399/111 |
| 6,097,908 | A | 8/2000 | Uchiyama et al. | 399/111 |
| 6,097,909 | A | 8/2000 | Watanabe et al. | 399/111 |
| 6,101,354 | A | 8/2000 | Nakagawa et al. | 399/225 |
| 6,118,960 | A | 9/2000 | Nakagawa et al. | 399/111 |
| 6,131,007 | A | 10/2000 | Yamaguchi et al. | 399/256 |
| 6,169,866 | B1 | 1/2001 | Watanabe et al. | 399/111 |
| 6,185,390 | B1 * | 2/2001 | Higeta et al. | 399/90 |
| 6,236,821 | B1 | 5/2001 | Yokoyama et al. | 399/113 |
| 6,246,848 | B1 | 6/2001 | Morinaga et al. | 399/106 |
| 6,246,849 | B1 | 6/2001 | Yokoyama et al. | 399/117 |
| 6,266,500 | B1 | 7/2001 | Numagami et al. | 399/104 |
| 6,272,299 | B1 | 8/2001 | Numagami et al. | 399/111 |
| 6,289,189 | B1 | 9/2001 | Numagami et al. | 399/111 |
| 6,324,370 | B1 | 11/2001 | Isobe et al. | 399/258 |
| 6,330,409 | B1 | 12/2001 | Watanabe et al. | 399/111 |
| 6,442,359 | B1 | 8/2002 | Numagami et al. | 399/110 |
| 6,463,233 | B2 | 10/2002 | Kojima et al. | 399/111 |
| 6,577,831 | B1 | 6/2003 | Kojima et al. | 399/111 |
| 6,608,980 | B2 | 8/2003 | Murayama et al. | 399/111 |
| 2002/0057924 | A1 | 5/2002 | Ueno et al. | 399/117 |
| 2002/0057928 | A1 | 5/2002 | Yasumoto et al. | 399/167 |
| 2002/0085854 | A1 | 7/2002 | Numagami et al. | 399/90 |
| 2002/0141788 | A1 | 10/2002 | Matsuda et al. | 399/260 |
| 2003/0049036 | A1 | 3/2003 | Ueno et al. | 399/25 |
| 2003/0133723 | A1 | 7/2003 | Fujita et al. | 399/111 |
| 2003/0175050 | A1 | 9/2003 | Murayama et al. | 399/256 |

* cited by examiner

*Primary Examiner*—Hoan Tran
(74) *Attorney, Agent, or Firm*—Fitzpatrick, Cella, Harper & Scinto

(57) ABSTRACT

A timing, at which fitting of a first support begins, a timing, at which fitting of a second support begins, and a timing, at which coupling of a high voltage contact and a contact pin provided on a side of a main body begins, respectively are staggered when a cartridge is mounted in the main body, whereby reduction of a burden on a user is achieved when the cartridge is mounted in the main body.

15 Claims, 10 Drawing Sheets

PROCESS CARTRIDGE AND ELECTROPHOTOGRAPHIC IMAGE FORMING APPARATUS

FIELD OF THE INVENTION AND RELATED ART

The present invention relates to a process cartridge capable of being mounted to and dismounted from an electrophotographic image forming apparatus, and an electrophotographic image forming apparatus.

Conventionally, there have been known process cartridges capable of being mounted to and dismounted from an electrophotographic image forming apparatus. Here, the electrophotographic image forming apparatus means one for forming an image on a recording medium by means of the electrophotographic image forming method. And the electrophotographic image forming apparatus exemplarily includes electrophotographic duplicating machines, electrophotographic printers (for example, laser beam printers, LED printers, and so on), facsimile apparatuses, word processors, and so on.

Also, the process cartridge means one, in which an electrophotographic photoreceptor and at least means as process means, such as charging means, developing means, cleaning means, and the like, contributing to an image forming process are integrally put together to be made a cartridge, the cartridge being enabled to be mounted to and dismounted from a body of an image forming apparatus.

Such cartridge system leads to an improvement in operability and enables a user to readily perform maintenance of members contributing to an image forming process. Hereupon, such cartridge system is widely used in a body of an image forming apparatus.

In the case where a process cartridge is mounted in an apparatus body, there are generated: (1) a load when a first support provided on the process cartridge and a first support provided on the apparatus body fit each other, (2) a load when a second support provided on the process cartridge and a second support provided on the apparatus body fit each other, and (3) a load at the time of connection of electric contacts.

SUMMARY OF THE INVENTION

As described above, when a process cartridge is mounted in an apparatus body, loads are generated in a plurality of locations. Desirably, a burden on an operator side, caused by loads in a plurality of locations is desirably reduced.

It is an object of the invention to provide a process cartridge, which can be improved in properties of mounting in a body of an electrophotographic image forming apparatus, and an electrophotographic image forming apparatus capable of mounting therein and dismounting therefrom the process cartridge.

It is a further object of the invention to provide a process cartridge, which can reduce loads when being mounted in a body of an electrophotographic image forming apparatus, and an electrophotographic image forming apparatus capable of mounting therein and dismounting therefrom the process cartridge.

It is a further object of the invention to provide a process cartridge capable of preventing deformation and breakage of a cartridge electric contact when being mounted in a body of an electrophotographic image forming apparatus, and an electrophotographic image forming apparatus capable of mounting therein and dismounting therefrom the process cartridge.

It is a further object of the invention to provide a process cartridge capable of surely bringing a cartridge contact portion and an electrode member of the body into contact with each other when the process cartridge is mounted in a body of an electrophotographic image forming apparatus, add an electrophotographic image forming apparatus capable of mounting therein and dismounting therefrom the process cartridge.

It is a further object of the invention to provide a process cartridge, detachably mountable to a body of an electrophotographic image forming apparatus having a body guide, a first support member, a second support member, and a body electrode member, the process cartridge comprising an electrophotographic photosensitive drum, process means to act on the electrophotographic photosensitive drum, a cartridge guide to engage with the body guide to guide the process cartridge in an axial direction of the electrophotographic photosensitive drum when the process cartridge is mounted in the body of the apparatus, a first fit portion provided on one end side of the electrophotographic photosensitive drum in the axial direction to engage with the first support member in the axial direction, when the process cartridge is mounted in the body of the apparatus, to position the process cartridge, a second fit portion provided on the one end side of the electrophotographic photosensitive drum in the axial direction to begin fitting with the second support member in the axial direction, after starting of fitting of the first fit portion and the first support member when the process cartridge is mounted in the body of the apparatus, to position the process cartridge, and a cartridge electric contact provided on the one end side to begin fitting with the body electrode member, after starting of fitting of the second fit portion and the second support member when the process cartridge is mounted in the body of the apparatus, to receive voltage being supplied to the process means from the body of the apparatus, and wherein the one end side is a tip end side in a direction, in which the process cartridge is mounted in the body of the apparatus.

It is a further object of the invention to provide a electrophotographic image forming apparatus for forming an image on a recording medium, the image forming apparatus comprising (i) a body guide, (ii) a first support member, (iii) a second support member, (iv) a body electrode member, (v) mount means for detachably mounting a process cartridge comprising an electrophotographic photosensitive drum, process means to act on the electrophotographic photosensitive drum, a cartridge guide to engage with the body guide to guide the process cartridge in an axial direction of the electrophotographic photosensitive drum when the process cartridge is mounted in the body of the apparatus, a first fit portion provided on one end side of the electrophotographic photosensitive drum in the axial direction to engage with the first support member in the axial direction, when the process cartridge is mounted in the body of the apparatus, to position the process cartridge, a second fit portion provided on the one end side of the electrophotographic photosensitive drum in the axial direction to begin fitting with the second support member in the axial direction, after starting of fitting of the first fit portion and the first support member when the process cartridge is mounted in the body of the apparatus, to position the process cartridge, and a cartridge electric contact provided on the one end side to begin fitting with the body electrode member, after starting of fitting of the second fit portion and the second support member when the process cartridge is mounted in the body of the apparatus, to receive voltage being supplied to the process means from the body of the apparatus, the one end side being a tip end side in a direction, in which the process cartridge is mounted in the body of the apparatus, and (vi) conveyance means for conveying the recording medium.

DETAILED DESCRIPTION OF THE PREFERRED EMBODIMENTS

A process cartridge 1 is detachable from an image forming apparatus (referred below to as a main body) 100 as described above.

The cartridge 1 is mounted on the main body 100 in the following order.

Figure 3:
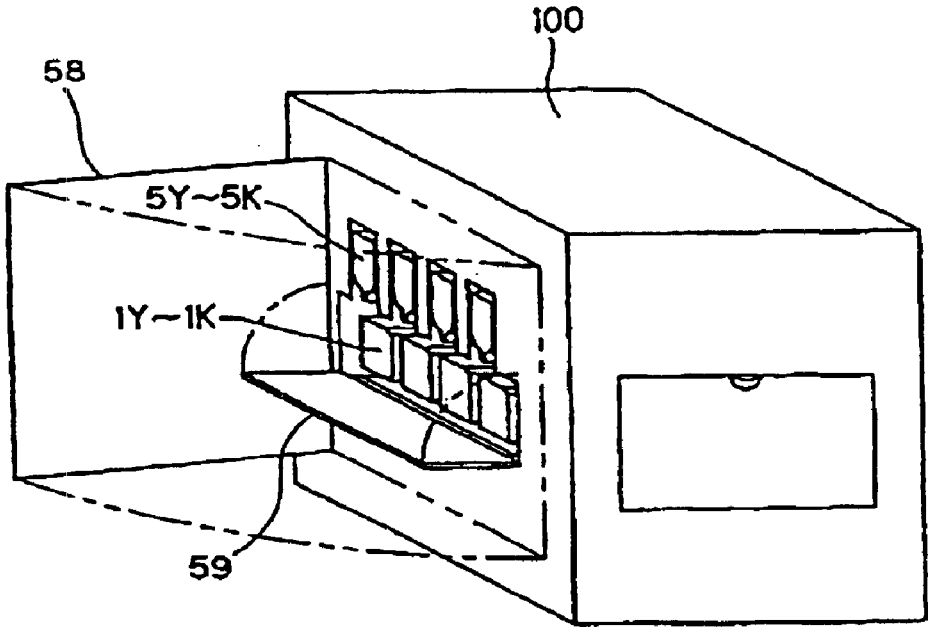
FIG. 3 is a schematic, perspective view showing a state, in which a front door of the image forming apparatus according to the embodiment of the invention is opened.

First, a front door 58 and a lid member 59, which are provided on the main body 100, are opened (see FIG. 3). Subsequently, the cartridge 1 is inserted along a guide rail 60 provided on the main body 100 (see FIG. 6).

Finally, a first support 200 and a second support 201, which are provided on the cartridge 1, respectively, are supported on a first support member 63*a* and a second support member 63*b*, which are provided on the main body 100.

In this manner, the cartridge 1 is correctly positioned relative to the main body 100. Thereby, with the image forming apparatus, in which a plurality of cartridges as shown in FIG. 3 are mounted, photosensitive drums 2 in the plurality of cartridges 1 are supported in parallel to one another to be able to correctly superpose images formed on the respective photosensitive drums 2 on one another.

Here, in order to facilitate mounting of the cartridge 1 when the cartridge 1 is guided on the guide rail 60 of the main body 100 for mounting thereon, the cartridge 1 is given some play (around 1 mm) relative to the guide rail 60.

An explanation will be given to an action, in which the cartridge 1 is mounted with such play and finally positioned on the image forming apparatus, with reference to FIG. 10.

Figure 10A:
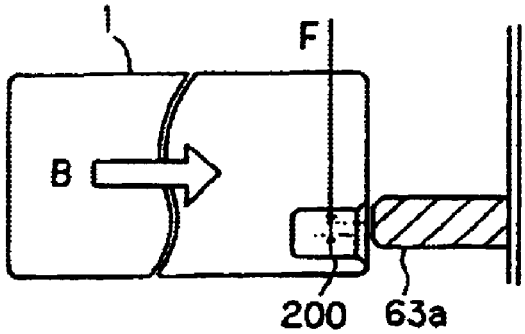
FIGS. 10A to 10C are views illustrating generation of loads on fit portions at the start of fitting when a process cartridge according to the embodiment of the invention is mounted in a body of the apparatus.

In FIG. 10A, the cartridge 1 is being supported on the guide rail 60 and mounted in a direction indicated by an arrow B.

At this time, the cartridge 1 is put in a state offset from the first support member 63*a* by a distance of the play (a distance F in the figure).

Figure 10B:
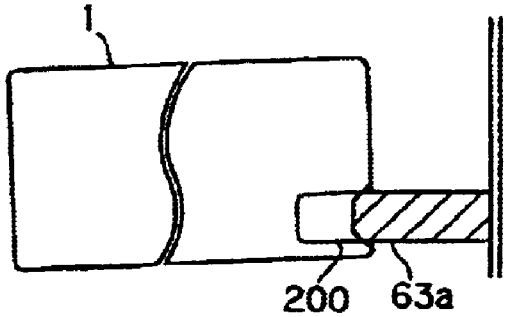

As shown in FIG. 10B, when the cartridge 1 is further moved in the direction of the arrow B, the first support 200 is fitted onto the first support member 63*a*.

At this time, the cartridge 1 is raised upwardly obliquely by the first support member 63*a* so as to accommodate an offset amounting to the distance F.

Figure 10C:
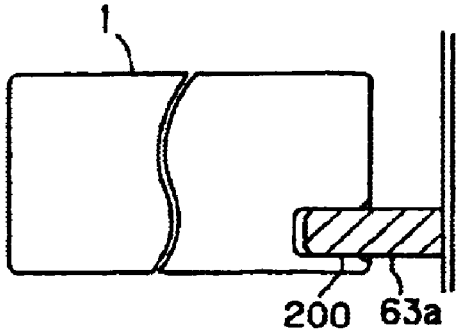

Further, when the cartridge 1 is moved in the direction of the arrow B, the first support 200 is surely fitted onto the first support member 63*a* as shown in FIG. 10C, so that the cartridge 1 is correctly positioned and supported in the main body 100.

As described with reference to FIG. 10B, when the cartridge 1 is mounted to the main body 100, the cartridge 1 is shifted to a state, in which it is supported by the first support member 63*a*, from a state, in which it is supported on the guide rail 60. At this time, the cartridge 1 must be lifted upwardly obliquely. Such upwardly oblique movement imposes a load on a user who performs mounting of the cartridge 1.

Such load is generated in all fit portions of the cartridges 1 and the main body 100.

Accordingly, stated with respect to the example of the image forming apparatus, a load is generated not only in the fit portions of the first support 200 and the first support members 63*a* but also in fit portions of the second support 201 and the second support member 63*b* at the time of fitting.

Figure 8:
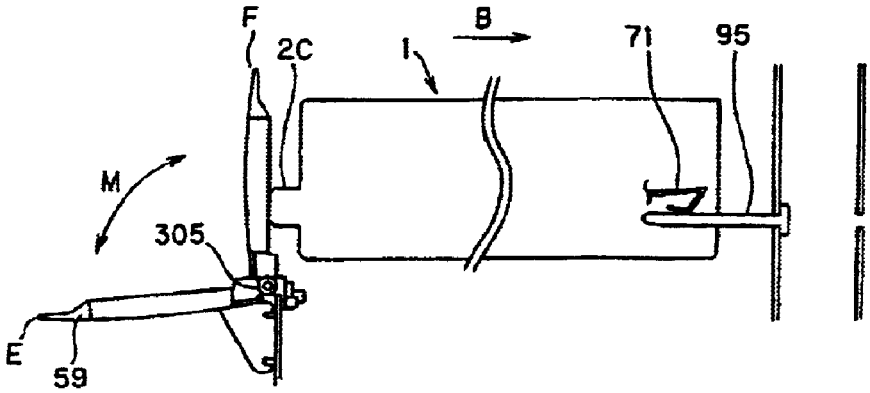
FIG. 8 is a schematic view showing a state, in which a process cartridge according to the embodiment of the invention is mounted in a body of the apparatus.

Also, as shown in FIG. 8, in order to supply electricity to various members constituting process means provided in the cartridge 1, it is necessary to connect a high voltage contact 71 provided in the cartridge 1 and a contact pin 95 provided on the main body 100 to each other. Such high voltage contacts are ordinarily provided in plural, and contact pressures on the plurality of high voltage contacts constitute a load on a user when the cartridges 1 are mounted.

In this manner, when the cartridge 1 is mounted to the main body 100, there are generated (1) a load when the first support 200 provided on the cartridge 1 is fitted onto the first support member 63*a* provided on the main body 100, (2) a load when the second support 201 provided on the cartridge 1 is fitted onto the second support member 63*b* provided on the main body 100, and (3) a load at the time of connection of the high voltage contact.

A preferred embodiment of the invention will be illustratively described in detail with reference to the drawings. However, the scope of the invention is not limited only to dimensions, materials, shapes, and relative arrangements of constituent parts described in the embodiment unless specifically described.

A longitudinal direction in the following descriptions means the same direction as an axial direction of an electrophotographic photosensitive drum (referred below to as photosensitive drum 2). Also, left and right mean left and right as viewed in a transfer direction of a recording medium 52. Further, upper and lower mean upper and lower in a state, in which a cartridge is mounted.

[Explanation of a Whole Image Forming Apparatus]

Figure 1:
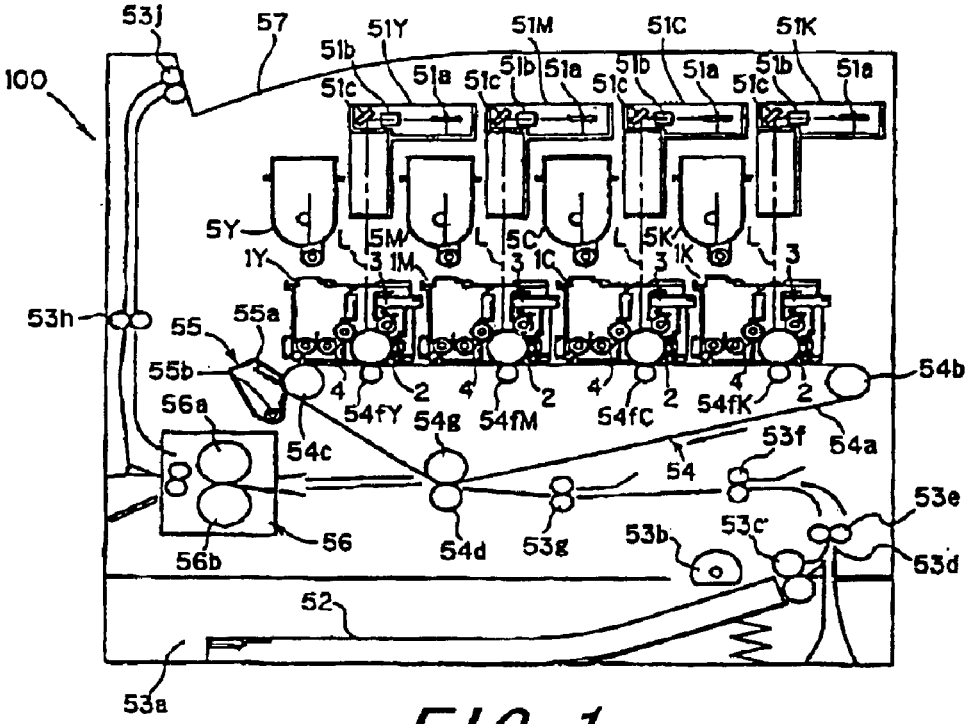
FIG. 1 is a longitudinal, cross sectional view showing an image forming apparatus according to an embodiment of the invention.

First, a whole constitution of a color electrophotographic image forming apparatus is generally described with reference to FIG. 1. FIG. 1 is a schematic view showing a constitution of an image forming apparatus according to the embodiment of the invention. More concretely, FIG. 1 is a view showing a whole constitution of a color laser beam printer being a configuration of a color toner image forming apparatus.

An image forming section of the color laser beam printer comprises cartridges 1Y, 1M, 1C, 1K (yellow color, magenta color, cyan color, black color) each comprising a photosensitive drum 2, and exposing means 51Y, 51M, 51C, 51K (laser beam optical scanning systems), respectively, provided above the cartridges 1Y, 1M, 1C, 1K to correspond to respective colors, the cartridges and the exposing means being arranged in parallel.

Arranged below the image forming section are feeding means for feeding a recording medium 52, an intermediary transfer belt 54*a* for transfer of toner images formed on the photosensitive drums 2, and a secondary transfer roller 54*d* for transferring toner images on the intermediary transfer belt 54*a* to the recording medium 52.

Further, there are arranged fixing means for fixing the toner images on the recording medium 52, to which the toner images have been transferred, and discharging means for discharging the recording medium 52 outside the apparatus to stack the same there.

Here, the recording medium 52 includes, for example, sheets, OHP sheets, cloth, or the like.

The image forming apparatus according to the embodiment adopts a cleanerless system. That is, that residual toner in transfer, which is left on the photosensitive drums 2, is taken into developing means and any exclusive cleaner for recovering and storing the residual toner in transfer is not arranged in the cartridge 1.

Subsequently, constitutions of respective sections of the image forming apparatus will be consecutively described in detail.

[Feeding Section]

A feeding section serves to feed the recording medium 52 to the image forming section. The feeding section mainly comprises a cassette 53*a* for stacking and storing a plurality of recording media 52, a feeding roller 53*b*, a retarding roller 53*c* for preventing double feeding, a feeding guide 53*d*, and registration rollers 53*g*.

The feeding roller 53*b* is driven and rotated according to an image forming operation. And the feeding roller separates and feeds the recording media 52 in the cassette 53*a* one by one. The recording medium 52 is guided by the feeding guide 53*d* to be transferred to the registration rollers 53*g* via transfer rollers 53*e*, 53*f*.

Immediately after transfer of the recording medium 52, the registration rollers 53*g* stop rotation. And the recording medium 52 abuts against a nip portion of the registration rollers 53*g* to thereby be corrected in skew.

In the image forming operation, the registration rollers 53*g* perform, in a predetermined sequence, an action of non-rotation for making the recording medium 52 stationary and standby, and an action of rotation for causing the recording medium 52 to be transferred to the intermediary transfer belt 54*a*. Then the registration rollers perform positioning of a toner image and the recording medium 52 in a subsequent transfer process.

[Process Cartridge]

The image forming apparatus according to the embodiment adopts a cleanerless system. Accordingly, the process cartridges in the embodiment are ones, in which charging means, the developing means, and the electrophotographic photosensitive drum are made integral, and adopt ones detachable from the main body 100.

That is, according to the embodiment, the cartridges 1Y, 1M, 1C, 1K comprise the charging means and the developing means, which are arranged around the photosensitive drums 2 to be made integral. The cartridge 1 (1Y, 1M, 1C, 1K) can be readily dismounted from the main body 100 by a user, and is exchanged when the life of the concerned photosensitive drum 2 comes to an end.

According to the embodiment, for example, in the case where the number of revolutions of the concerned photosensitive drum 2 is counted and a predetermined count number is exceeded, it is reported that the life of the cartridge 1 comes to an end. However, it goes without saying that judgment of the life of the cartridge 1 is not limited thereto but it is possible to adopt other ways of judgment.

The photosensitive drums 2 according to the embodiment comprise an organic photoreceptor adapted to be charged negative, and an ordinarily used photosensitive layer is provided on an aluminum drum substrate having a diameter of about 30 mm to have a charge-injection layer provided on an uppermost layer thereof. The photosensitive drums 2 are rotatingly driven at a predetermined process speed, and at about 117 mm/sec in the embodiment.

The charge-injection layer uses a coating layer of a material having a binder of an insulating resin, in which, for example, ultrafine particles of SnO2 are dispersed as conductive fine particles.

Figure 4:
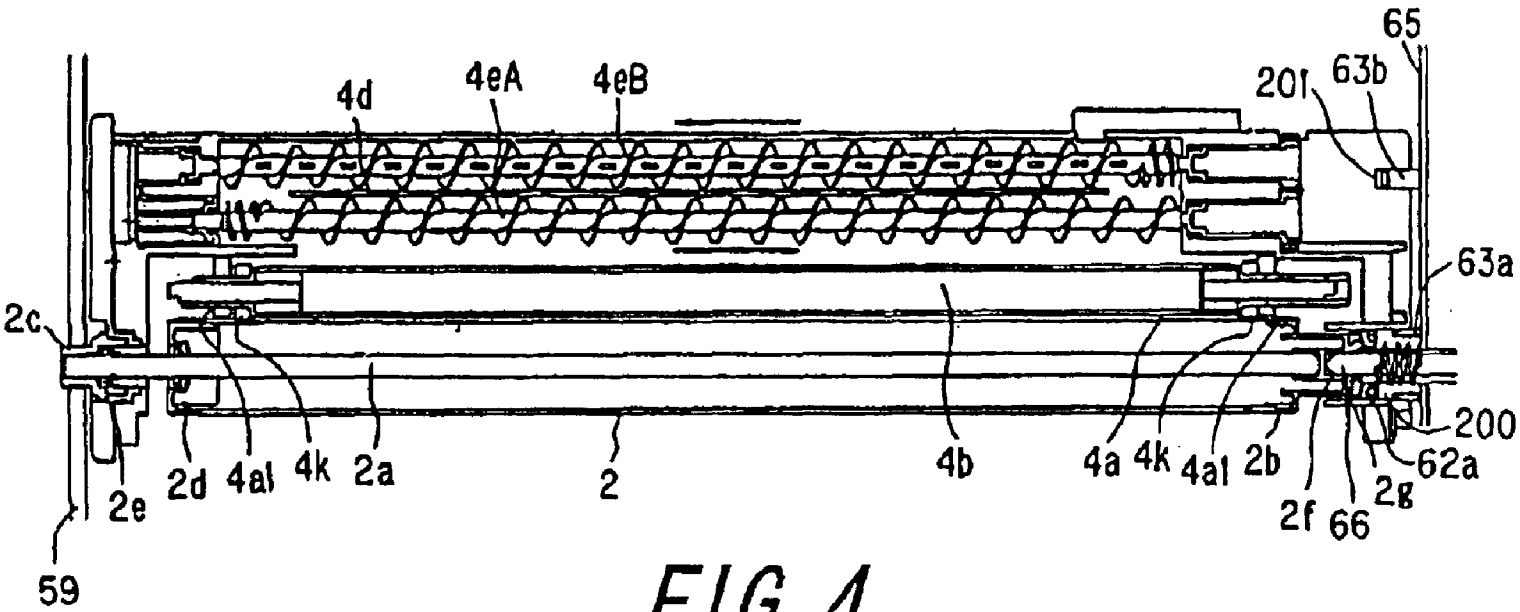
FIG. 4 is a cross sectional view showing a process cartridge, according to the embodiment of the invention, in a longitudinal direction.

As shown in FIG. 4, a drum flange 2*b* is fixed to an inner-side end (an end on an inner side where the process cartridge 1 is inserted, and on a right side in FIG. 4) of the concerned photosensitive drum 2. A non-drive flange 2*d* is fixed to an end (an end on a side where the cartridge 1 is taken out, and on a left side in FIG. 4) of the drum on this side. A drum shaft 2*a* extends to the centers of the drum flange 2*b* and the non-drive flange 2*d*. And the drum shaft 2*a*, the flange 2*b*, and the non-drive flange 2*d* rotate integrally. That is, the photosensitive drum 2 rotates about an axis of the drum shaft 2*a*.

The non-driven end of the drum shaft 2*a* is rotatably supported by a bearing 2*e*, and the bearing 2*e* is fixed to a bearing casing 2*c*. And the bearing casing 2*c* is fixed to a frame of the process cartridge 1.

[Charging Means]

The charging means makes use of a contact charging method. In the embodiment, charging rollers 3*a* are used as charging members.

Figure 2:
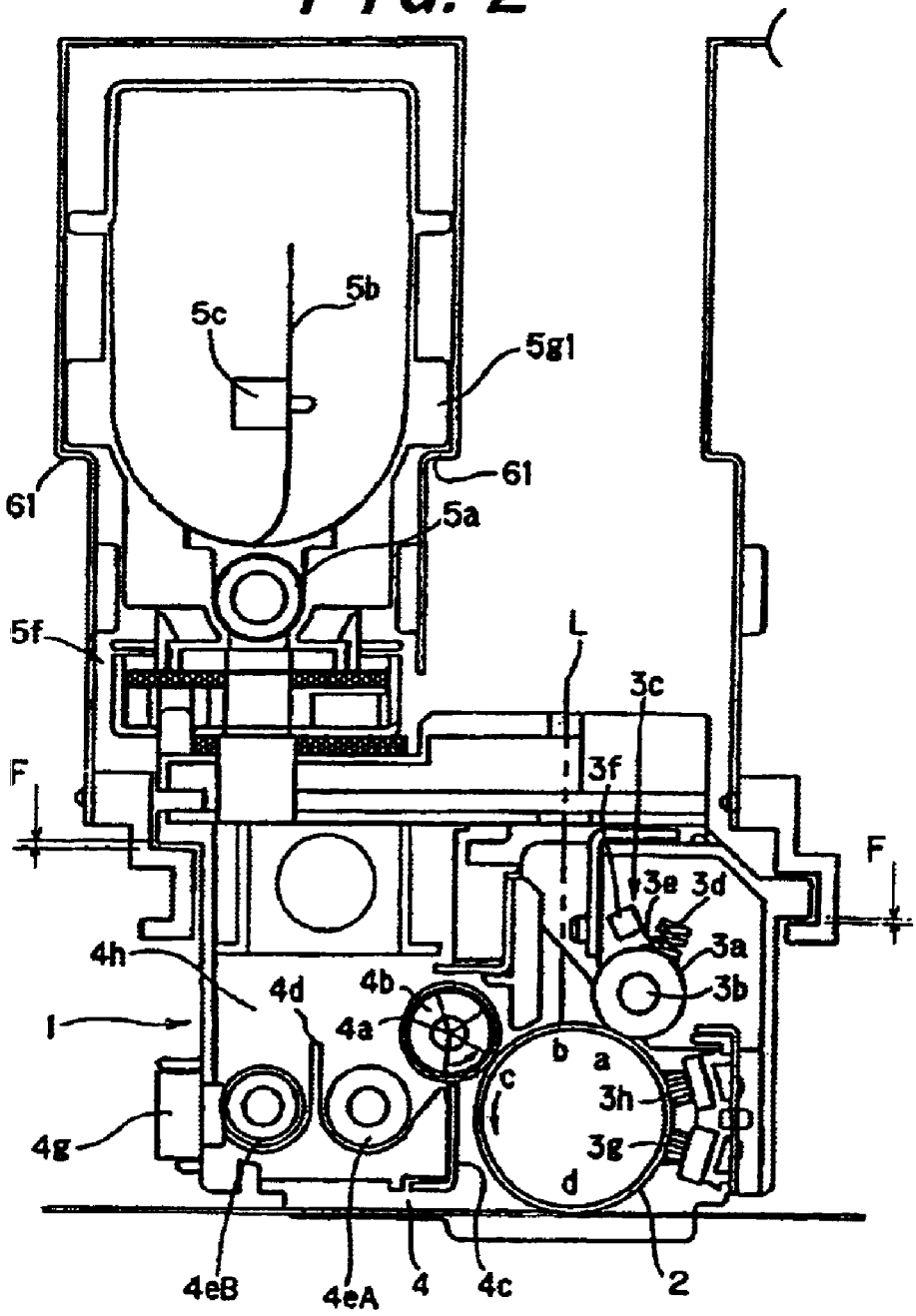
FIG. 2 is a longitudinal, cross sectional view showing a process cartridge and a toner supply container according to the embodiment of the invention.

As shown in FIG. 2, the charging roller 3*a* has both ends of a core bar 3*b* rotatably held by bearing members (not shown), and is biased toward the photosensitive drum by a pressing spring 3*d*. Thereby, a predetermined pressing force brings the charging roller 3*a* into pressure contact with a surface of the photosensitive drum 2. Therefore, the charging roller is rotated according to rotation of the photosensitive drum 2.

The reference character 3*c* denotes a charging roller cleaning member having a flexible cleaning film 3*e* in the embodiment. The film 3*e* is arranged in parallel to a longitudinal direction of the charging roller 3*a*. Further, the film is arranged such that an end thereof is fixed to a support member 3*f*, which reciprocates a predetermined distance in the longitudinal direction, and a surface thereof near a free end thereof forms a contact nip on the charging roller 3*a*. The support member 3*f* is caused by drive means (not shown) to reciprocate a predetermined distance in the longitudinal direction whereby the cleaning film 3*e* slidingly contacts with the surface of the charging roller. Thereby, extraneous matter (fine toner, external additive, or the like) on the surface of the charging roller are removed.

Here, the image forming apparatus according to the embodiment adopts a cleanerless system. The cleanerless system will be described.

[Cleanerless System]

An outline of the cleanerless system in the image forming apparatus according to the embodiment will be first described. As the photosensitive drum 2 rotates subsequently, the cleanerless system permits that residual toner in transfer, which is left on the surface of the photosensitive drum 2, to pass through a charging section a and an exposing section b to be carried onto a developing section c and to be developed and simultaneously cleaned (recovered) by a developing device.

Since that residual toner in transfer, which is left on the surface of the photosensitive drum 2, passes through the exposing section b, it is subjected to an exposing process, but no great influence results since the residual toner in transfer is small in amount.

In the embodiment, toner residue (image of a remaining developer) equalizing means 3*g* for equalizing that residual toner in transfer, which is left on the surface of the photosensitive drum 2, is provided in a position downstream of a transfer section d on the photosensitive drum. Also, toner (developer) charging control means 3*h* for making all charging polarities of that residual toner in transfer, a negative polarity being a normal polarity is provided in a position downstream of the toner residue equalizing means 3*g* in a rotational direction of the photosensitive drum and upstream of the charging section a in the rotational direction of the photosensitive drum.

Owing to the provision of the toner residue equalizing means 3*g*, that residual toner in transfer, which is left in a pattern on the surface of the photosensitive drum 2 and which is carried to the toner charging control means 3*h* from the transfer section d, is dispersed and distributed on the surface of the photosensitive drum to be non-patterned even when the residual toner in transfer is large in amount. Accordingly, toner will not concentrate on a part of the toner charging control means 3*h* and that processing, in which the residual toner in transfer is generally charged to a normal polarity, is adequately performed by the toner charging control means 3*h* at all times, so that the residual toner in transfer is effectively prevented from adhering to the charging roller 3*a*. Also, the pattern of the residual toner in transfer is also prevented from generating a ghost image.

In the embodiment, the toner residue equalizing means 3*g* and the toner charging control means 3*h* are made of brush-shaped members having an appropriate conductivity, and brush portions are arranged to be in contact with the surface of the photosensitive drum.

Also, these means are moved (reciprocated) by a drive source (not shown) in the longitudinal direction of the photosensitive drum. Thereby, the toner residue equalizing means 3*g* and the toner charging control means 3*h* will not continue to remain in the same positions on the photosensitive drum. Accordingly, even when unevenness of the toner charging control means 3*h* in resistance causes overcharged portions and insufficiently charged portions to exist, such portions will not always be formed on the same portions of the photosensitive drum. Accordingly, it is possible to prevent or mitigate generation of fusion on the photosensitive drum due to overcharging of a minimum residual toner in transfer and adherence of the residual toner in transfer, to the charging roller 3*a* due to insufficiency of charging.

[Exposing Means]

In the embodiment, exposure to the photosensitive drum 2 is performed by means of laser exposing means. More specifically, when an image signal is forwarded from the apparatus body, an evenly charged surface of the photosensitive drum 2 is scanned by and exposed to a laser light L modulated corresponding to the signal. And an electrostatic latent image corresponding to image information is selectively formed on the surface of the photosensitive drum 2.

The laser exposing means is composed of a solid laser element (not shown), a polygon mirror 51*a*, an imaging lens 51*b*, a reflective mirror 51*c*, and so on. On the basis of an input image signal, a flash signal generator (not shown) controls ON/OFF light emission of the solid laser element at a predetermined timing. The laser light L emitted from the solid laser element is converted into a substantially parallel light flux by a collimator lens system (not shown) and caused by the high-speed rotating polygon mirror 51*a* to be scanned. And the light forms a spot-shaped image on the photosensitive drum 2 via the imaging lens 51*b* and the reflective mirror 51*c*.

In this manner, the surface of the photosensitive drum 2 is subjected to exposure in a main scanning direction by a laser light scanning and exposure in a sub-scanning direction upon rotation of the photosensitive drum 2, and a distribution of exposure is thus obtained corresponding to an image signal.

That is, irradiation and non-irradiation of the laser light L form a bright electric potential decreased in surface potential and a dark electric potential not decreased in surface potential. An electrostatic latent image corresponding to image information is formed by contrast between the bright electric potential and the dark electric potential.

[Developing Means]

A developing device 4 being developing means comprises a two-component contact developing device (two-component magnetic brush developing device) in the embodiment. The developing device 4 comprises a developing sleeve 4*a*, which comprises a developer carrier receiving therein a magnet roller 4*b*, as shown in FIG. 2. And a developer composed of carrier and toner is held on the developing sleeve 4*a*. A regulatory blade 4*c* is provided on the developing sleeve 4*a* with a predetermined clearance therebetween. Owing to the provision of the regulatory blade 4*c*, a thin-layered developer is formed on the developing sleeve 4*a* as the developing sleeve 4*a* rotates in a direction indicated by an arrow in the figure.

Spacers 4*k* are rotatably fitted onto small-diameter journal portions 4*al* on both sides of the developing sleeve 4*a* as shown in FIG. 4 to provide predetermined gaps between the developing sleeve 4*a* and the photosensitive drum 2. And setting is made such that at the time of developing a developer formed on the developing sleeve 4*a* can perform developing in a state of contact with the photosensitive drum 2.

The developing sleeve 4*a* is rotatingly driven at a predetermined peripheral speed in a direction indicated by an arrow and opposed to the rotational direction of the photosensitive drum 2.

A negatively charged toner having an average particle size of 6 (m is used as toner in the embodiment, and magnetic carrier having the saturation magnetization of 205 emu/cm$^3$ and an average particle size of 35 (m is used as magnetic carrier. Also, a mixture of toner and carrier at a weight ratio of 6:94 is used as a developer.

A developer storage section 4*h*, in which a developer circulates, is divided, except for both ends thereof, into two halves by a longitudinal partition 4*d*. And agitating screws 4*e*A, 4*e*B are arranged with the partition 4*d* therebetween.

Toner furnished from a toner supply container is permitted to fall on an inner side (a right side in FIG. 4) of the agitating screw 4eB, agitated while being fed to a front side (a left side in FIG. 4) in the longitudinal direction, and passes a portion on the front side end to be clear of the partition 4d. And toner is fed to the inner side in the longitudinal direction by the agitating screw 4eA this time. And toner passes a portion on the inner side end to be clear of the partition 4d, and is agitated while being fed by the agitating screw 4eB. In this manner, toner is repeatedly circulated.

Here, an explanation will be given to a developing process, in which an electrostatic latent image on the photosensitive drum 2 is visualized by the two-component magnetic brush method with the use of the developing device 4, and a circulating system of a developer.

As the developing sleeve 4a rotates, a developer in the developer container is drawn onto the surface of the developing sleeve 4a by a drawing electrode of the magnet roller 4b to be conveyed.

In the conveyance step, the developer is regulated in layer thickness by the regulatory blade 4c disposed vertical relative to the developing sleeve 4a, and a thin-layered developer is formed on the developing sleeve 4a. When the thin-layered developer is conveyed to a developing electrode corresponding to the developing section, magnetic forces form ears. The electrostatic latent image on the surface of the photosensitive drum 2 is developed as a toner image by toner in the developer in the form of ears. In the embodiment, the latent image is reversely developed.

The thin-layered developer on the developing sleeve 4a having passed through the developing section c consecutively enters the developer container with rotation of the developing sleeve 4a, and is separated from the developing sleeve 4a by a repulsive, magnetic field of the conveyance electrode to be returned to a developer mass in the developer container.

DC voltage and AC voltage are applied on the developing sleeve 4a from a power source (not shown). In the embodiment, DC voltage of −500 V and AC voltage having a frequency of 2000 Hz and a peak intermediary voltage of 1500 V are applied, and developing is selectively effected on only an exposed portion of the photosensitive drum 2.

When toner is consumed in developing, the developer is decreased in concentration of toner. In the embodiment, a sensor 4g for detecting the concentration of toner is arranged in a position close to an outer peripheral surface of the agitating screw 4eB. When the sensor 4g detects that concentration of toner in the developer is lowered below a predetermined concentration level, a command for supplying toner into the developing device 4 from a toner supply container is issued. The toner supplying operation controls concentration of toner in the developer to maintain the same on a predetermined level at all times.

[Toner Supply Container]

Toner supply containers 5Y, 5M, 5C, 5K are arranged in parallel to one another above the process cartridges 1Y, 1M, 1C, 1K, and mounted from a front surface of the main body 100.

As shown in FIG. 2, an agitating plate 5b fixed to an agitating shaft 5c and a screw 5a are arranged in the respective toner supply containers, and a discharge opening 5f for discharge of toner is provided on a bottom of the container.

Figure 5:
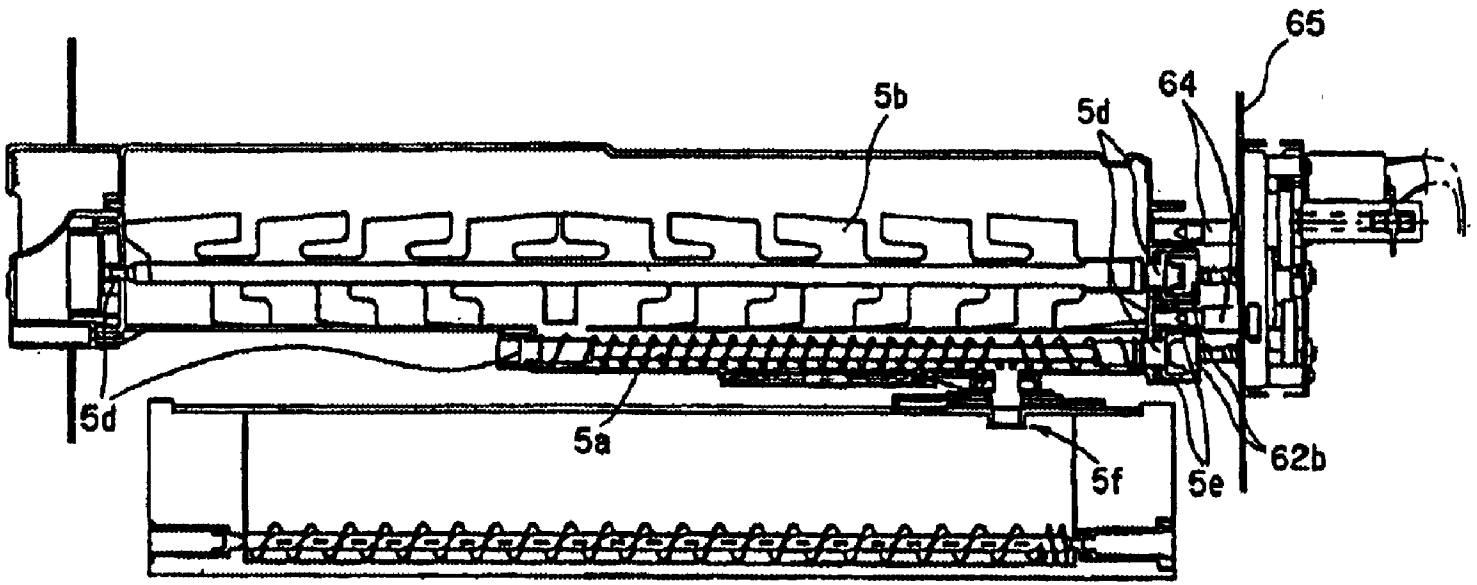
FIG. 5 is a cross sectional view showing a toner supply container and a process cartridge, according to the embodiment of the invention, in a longitudinal direction.

As shown in FIG. 5, the screw 5a and the agitating shaft 5c are rotatably supported at both ends thereof by bearings 5d, and drive couplings (concave) 5e are arranged on one endmost portions thereof. A drive is transmitted to the drive couplings (concave) 5e from drive couplings (convex) 62b of the apparatus body to rotatingly drive the drive couplings. An external shape of the screw 5a is in the form of a spiral-rib, and the spiral is reversed in a direction of twist with the discharge opening 5f as a center. Rotation of the drive couplings (convex) 62b causes rotation of the screw 5a in a predetermined direction of rotation.

Toner is conveyed toward the discharge opening 5f and freely falls through an opened portion of the discharge opening 5f to be supplied to the process cartridge 1.

A tip end of the agitating plate 5b in a rotationally radial direction is inclined, and abuts against wall surfaces of the toner supply container when it slidingly contacts therewith. Concretely, a tip end portion of the agitating plate 5b is twisted to become spiral. In this manner, the tip end portion of the agitating plate 5b is twisted and inclined to thereby generate a conveyance force in an axial direction, so that toner is fed in the longitudinal direction.

In addition, the toner supply container according to the embodiment enables supply to a process cartridge or a developing cartridge making use of not only the two-component developing method but also the one-component developing method. Also, it goes without saying that powder received in the toner supply container is not limited to toner but may comprise a developer, in which toner and a magnetic carrier are mixed.

[Transfer Means]

An intermediary transfer unit 54 being transfer means performs secondary transfer of a plurality of toner images, which have been consecutively subjected to primary transfer from the photosensitive drum 2 to be stacked on one another, to the recording medium 52 collectively.

The unit 54 is provided with the intermediary transfer belt 54a, which runs in the direction indicated by an arrow, and runs at substantially the same peripheral speed as an outer peripheral speed of the photosensitive drum 2 in the direction indicated by an arrow. The intermediary transfer belt 54a comprises an endless belt having a peripheral length of about 940 mm and trained around three rollers, that is, a drive roller 54b, a secondary transfer opposing roller 54g, and a driven roller 54c.

Further, transfer charging rollers 54fY, 54fM, 54fC, 54fK, respectively, are rotatably arranged in the transfer belt 54a to be positioned in opposition to the photosensitive drums 2, and biased toward centers of the photosensitive drums 2.

The charging rollers 54fY, 54fM, 54fC, 54fK are supplied with electricity from a high voltage power supply (not shown) and perform charging of reverse polarity from a back side of the transfer belt 54a. And toner images on the photosensitive drums 2 are consecutively subjected to primary transfer to an upper surface of the transfer belt 54a.

The secondary transfer roller 54d serving as a transfer member in the secondary transfer section is positioned in opposition to the secondary transfer opposing roller 54g to be brought into pressure contact with the intermediary transfer belt 54a. The transfer roller 54d is swingable vertically as viewed in the figure and rotates. At this time, since bias is applied to the transfer belt 54a, toner images on the transfer belt 54a are transferred to the recording medium 52.

Here, the intermediary transfer belt 54a and the secondary transfer roller 54d, respectively, are driven. The recording medium 52 runs into the secondary transfer section. And a predetermined bias is applied to the secondary transfer roller 54d, so that toner images on the transfer belt 54a are transferred to the recording medium 52.

At this time, the recording medium 52 put in a state interposed between both is subjected to transfer processing and simultaneously conveyed at a predetermined speed in a leftward direction in the FIG. 1 to be conveyed toward a fixing device 56, in which a subsequent processing is performed.

A cleaning unit 55 capable of coming toward and away from the surface of the transfer belt 54*a* is provided in a predetermined position on the transfer belt 54*a* and on a most downstream side in the transfer processing to remove the residual toner remaining after the secondary transfer.

A cleaning blade 55*a* is arranged in the cleaning unit 55 to remove the residual toner in transfer. The cleaning unit 55 is mounted to be swingable about a center of turning (not shown), and the cleaning blade 55*a* is brought into pressure contact with the intermediary transfer belt 54*a* in a direction, in which it invades into the belt. That residual toner in transfer, which has been taken into the cleaning unit 55, is conveyed to a waste toner tank (not shown) by a feeding screw to be stored therein.

[Fixing Section]

Toner images formed on the photosensitive drums 2 by the developing means are transferred to the recording medium 52 via the intermediary transfer belt 54*a*. And the toner images transferred to the recording medium 52 are fixed to the recording medium 52 by the fixing device 56 with the use of heat.

As shown in FIG. 1, the fixing device 56 comprises a fixing roller 56*a* for applying heat to the recording medium 52, and a pressure roller 56*b* for bringing the recording medium 52 into pressure contact with the fixing roller 56*a*, the respective rollers being hollow.

The respective rollers comprise heaters (not shown) therein. The rollers are rotatingly driven-to simultaneously convey the recording medium 52.

More specifically, the recording medium 52 holding toner images thereon is conveyed by the fixing roller 56*a* and the pressure roller 56*b* and the toner images are fixed to the recording medium 52 by application of heat and pressure. The recording medium 52 having been subjected to fixing is discharged by discharge rollers 53*h*, 53*j* to be stacked on a tray 57 on the main body 100.

[Mounting of Process Cartridge and Toner Supply Container]

Subsequently, an explanation will be given to a procedure of mounting of a cartridge and a toner supply container with reference to FIGS. 2 to 4 and FIG. 5.

The openable front door 58 is arranged in front of the main body 100, and when the front door 58 is opened this side, an opening to permit insertion of the cartridge and the toner supply container is exposed (see FIG. 3).

Arranged on the opening to permit insertion and drawing of the cartridge 1 is the lid member 59 turnably supported thereon. And insertion and drawing of the process cartridge is performed after the lid member 59 is opened (see FIG. 3).

Fixed in the main body 100 are a guide rail 60 for guiding mounting of the cartridge 1, and a guide rail 61 for guiding mounting of the toner supply container.

A direction, in which the cartridge 1 and the toner supply container are mounted, is parallel to an axial direction of the photosensitive drum 2, and the guide rails 60, 61 are arranged in the same direction as the direction. The cartridge 1 and the toner supply container are initially slid from this side in the main body 100 to an inner side therein along the guide rails 60, 61 to be inserted thereinto.

When the cartridge 1 is inserted into an innermost area in the apparatus body, a centering shaft 66 of the apparatus body is inserted into a center hole 2*f* of the drum flange 2*b*, so that a position of center of rotation of the photosensitive drum 2 on the inner side thereof is determined relative to the apparatus body. Also, simultaneously with this, a drive transmission portion 2*g* formed on the drum flange 2*b* and a drive coupling (convex) 62*a* are coupled to each other to afford driving rotation of the photosensitive drum 2. The drive transmission portion 2*g* used in the embodiment is in the form of a twisted triangular prism, to which drive is transmitted upon application of drive forces from the body and which generates a force to draw the photosensitive drum 2 to the inner side thereof.

Also, provided on a rear side plate 65 are support pins (a first support member 63*a*, and a second support member 63*b*) to position the process cartridge. And the support pins are inserted into the cartridge 1 to fix a position of the frame.

The turnable lid member 59 is arranged this side of the main body 100, and the bearing casing 2*c* of the cartridge 1 is supported on and fixed to the lid member 59. These series of inserting operations cause the apparatus body 2 and the cartridge 1 to be positioned relative to the apparatus body.

Meanwhile, when the toner supply container is inserted into an innermost area in the apparatus body, it is fixed to support pins 64 projecting from the rear side plate 65. Also, simultaneously with this, the drive couplings (concave) 5*e* and drive couplings (convex) 62*b* are coupled to each other to afford driving rotation of the screw 5*a* and the agitating shaft 5*c*.

Subsequently, a further detailed explanation will be given to a construction for mounting the cartridge 1 on the main body 100, in particular, with reference to FIGS. 8 and 9.

Figure 7:
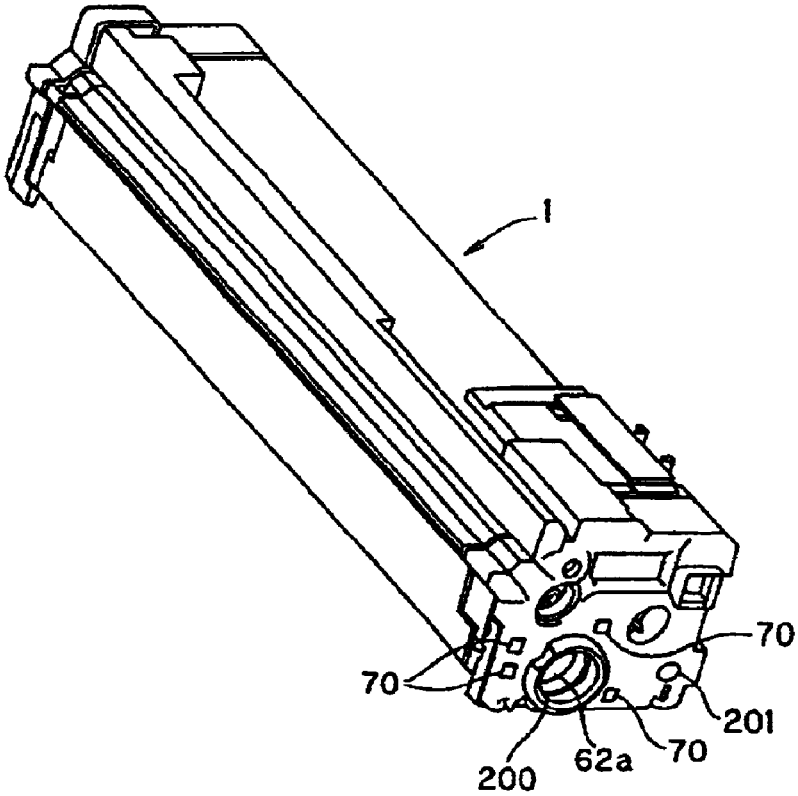
FIG. 7 is a perspective view showing a process cartridge according to the embodiment of the invention.

FIG. 9 is a view illustrating a way to mount the cartridge 1 on the main body 100, and showing the cartridge 1 with a posture of the cartridge in FIG. 7 viewed from above.

Figure 6:
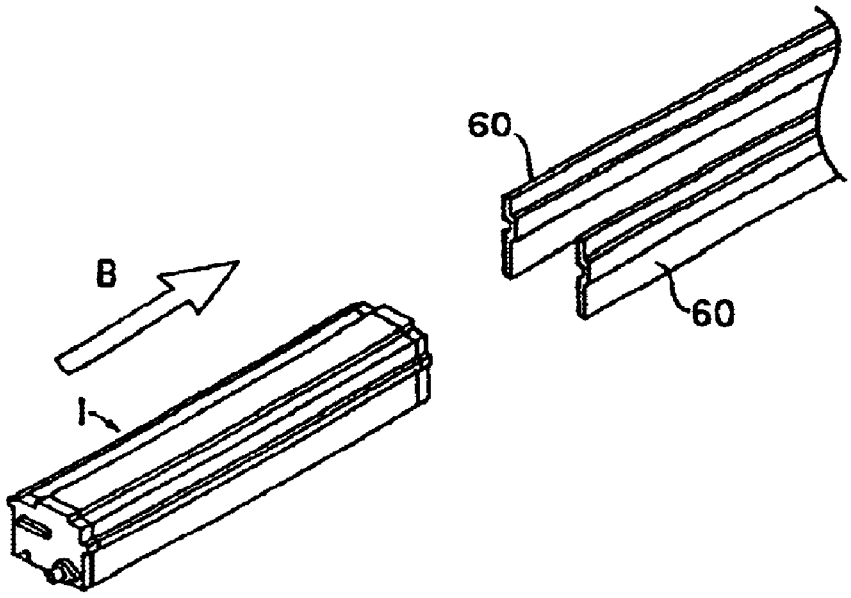
FIG. 6 is a perspective view illustrating a mechanism for mounting a process cartridge in a body of the apparatus, according to the embodiment of the invention.

In the embodiment, the cartridge 1 is mounted in the main body 100 to an inner side (direction indicated by an arrow B) from front side of the main body 100 as shown in FIG. 6 and FIG. 8.

The main body 100 has an opening for mounting of the cartridge 1, and the lid member 59 covering the opening moves about a center 305 of turning in a direction of an arrow M to afford opening and closing of the opening.

When the cartridge 1 is mounted in the main body 100, the cartridge 1 is inserted through the opening, which is provided on the main body 100 for mounting of the cartridge 1, to be mounted along the guide rail 60 (FIG. 6) provided on the main body 100.

The cartridge 1 is provided on a mount tip end surface thereof with a fit portion and a contact connecting portion, where the cartridge 1 is connected to the main body 100. These portions are responsible for loads at the time of mounting of the cartridge 1.

(1) First, there are fit portions of the first support 200 provided on the cartridge 1 and of the first support member 63*a* provided on the main body 100. In addition, with the embodiment, the first support 200 comprises a fit hole, and the first support member 63*a* comprises a fit projection adapted to be fitted into the fitted hole.

The fit portions are provided coaxial with the photosensitive drum 2, and make a reference, on which the cartridge 1 is positioned on the main body 100.

(2) Second, there are fit portions of the second support 201 provided on the cartridge 1 and of the second support member 63*b* provided on the main body 100. In addition, with the embodiment, the second support 201 comprises a fit hole, and the second support member 63*b* comprises a fit projection adapted to be fitted into the fit hole. Also, the first support 200 and the second support 201 are made of the same member.

The fit portions in (2) are provided in order that the cartridge 1 supported by the fit portions in (1) be determined in posture in a direction of turning about the photosensitive drum 2 when viewed in the cross sectional view of FIG. 1.

(3) Third, there are the high voltage contact 71 provided on the cartridge 1 and a contact coupling portion between the high voltage contact 71 and the contact pin 95 provided on the main body 100. In addition, the high voltage contact 71 is provided in a contact pin insertion port 70 provided on an end surface of the cartridge 1 on an insertion side thereof.

And in the embodiment, the process cartridge 1 is mounted in the order of from FIG. 9A to FIG. 9D.

Figure 9A:
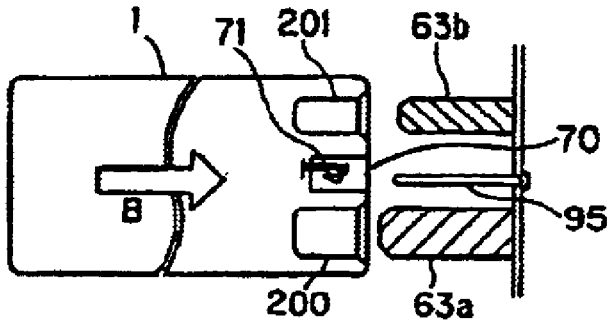
FIGS. 9A to 9D are views illustrating mounting operations when a process cartridge according to the embodiment of the invention is mounted in a body of the apparatus.
Figure 9B:
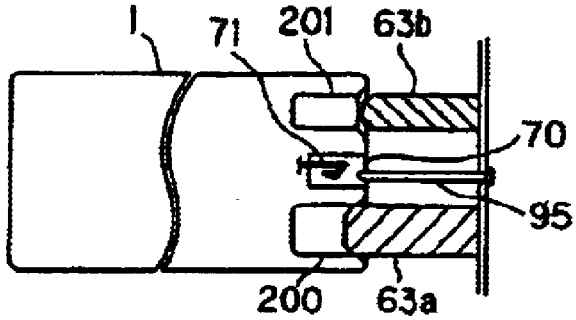

FIG. 9A shows a state in the course of insertion of the cartridge 1 along the guide rail 60, and loads have not yet been generated on the fit portions in (1) to (3).

When the cartridge 1 is further inserted, fitting begins between the first support 200 provided on the cartridge 1 and the first support member 63*a* provided on the main body 100. That is, fitting of the fit portions in (1) begins. At this time, a load for fitting of the fit portions in (1) is generated (see FIG. 9B).

Thereafter, as the cartridge 1 is further inserted, the first support 200 slides relative to the first support member 63*a* in a stable condition. Therefore, the load for fitting of the fit portions in (1) is dissolved.

And as the cartridge 1 is further inserted, fitting begins between the second support 201 provided on the cartridge 1 and the second support member 63*b* provided on the main body 100. That is, fitting of the fit portions in (2) begins. At this time, a load for fitting of the fit portions in (2) is generated.

Thereafter, as the cartridge 1 is further inserted, the second support 201 slides relative to the second support member 63*b* in a stable condition. Therefore, the load for fitting of the fit portions in (2) is dissolved.

Figure 9C:
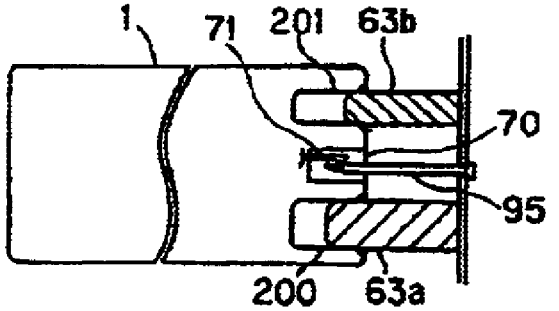

As the cartridge 1 is further inserted, the high voltage contact 71 provided on the cartridge 1 and the contact pin 95 provided on the main body 100 begins contact with each other (see FIG. 9C). That is, coupling of the contact coupling portions in (3) begins and a load for fitting of the coupling portions in (3) is generated.

Figure 9D:
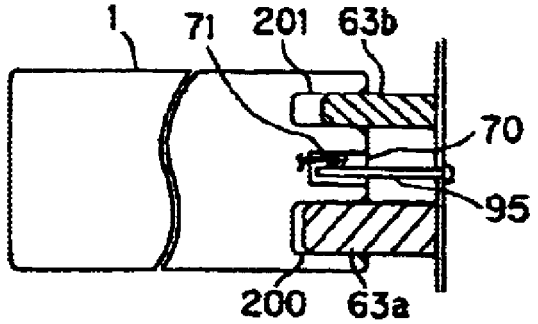

And when the cartridge 1 is further inserted, mounting of the cartridge 1 is completed (see FIG. 9D).

In this manner, loads generated by fitting or coupling in the fit portions in (1) and (2) and the coupling portions in (3) are staggered in timing.

Accordingly, loads in mounting the cartridge 1 in the main body 100 are prevented from being increased, and so an improvement is achieved in usability.

In this manner, loads generated in a plurality of locations at the time of mounting of the cartridge 1 are staggered in timing, whereby it is possible to reduce loads when mounting is performed by a user.

Accordingly, even when the order is not limited to one described above but is changed to another provided that loads generated are staggered in timing, it is possible to reduce loads at the time of mounting.

However, the above order is meaningful as follows.

As in the embodiment, with an image forming apparatus capable of mounting therein a plurality of cartridges, a plurality of photosensitive drums, respectively, are supported in parallel to one another in a apparatus body. Accordingly, it is essential that the photosensitive drum 2 serving as a reference of mounting the cartridge 1 in the main body 100 is preceedingly positioned. Hereupon, the fit portions in (1) provided coaxial with the photosensitive drum 2 first fit each other as shown in FIG. 4.

Also, as shown in a cross sectional view of the process cartridge 1 in FIG. 2, the charging device 3 and the developing device 4 are provided left and right centering on the photosensitive drum 2. Therefore, the process cartridge 1 is well balanced centering on the photosensitive drum 2 in a cross section shown in FIG. 2. Therefore, the process cartridge 1 can be made stable in posture until fitting in (2) is performed after the cartridge is determined in a position coaxial with the photosensitive drum 2.

And after a central axis of the photosensitive drum 2 is positioned and positioning in the direction of rotation is effected, the high voltage contact 71 and the contact pin 95 are coupled to each other. Therefore, application of excessive loads on these elements can be prevented and failure in connection of electric contacts can be prevented.

Further, loads in mounting the cartridge 1 in the main body 100 are prevented from being increased. Therefore, it is possible to surely mount the process cartridge 1 on in the main body 100. Accordingly, it is possible to suppress failure in connection of drive transmitting portions and electric contacts, which constitute coupling portions between the main body 100 and the cartridge 1.

The respective embodiments of the invention are summarized and the explanation thereof is supplemented.

The process cartridge 1 according to the embodiment of the invention comprises, in an integral manner, the photosensitive drum 2, the charging means (the charging roller 3*a*, and so on) and the developing means (the developing sleeve 4*a*, and so on) in the embodiment, which serve as at least one process member contributing to the image forming process, and the high voltage contact 71 serving as an electricity supply contact member for supplying electricity to the charging means and the developing means, and the cartridge 1 being configured to be detachable from the main body 100 to comprise the first support 200 constituting a first fit portion, by which an axial position of the photosensitive drum 2 relative to the main body 100 is determined, and the second support 201 constituting a second fit portion, by which a position of the photosensitive drum 2 relative to the main body 100 in a direction of rotation is determined, a timing, at which fitting of the first support 200 begins, a timing, at which fitting of the second support 201 begins, and a timing, at which coupling of the high voltage contact 71 and the contact pin 95 provided on a side of the main body 100 to serve as an electricity supply portion begins, respectively being staggered when the cartridge 1 is mounted in the main body 100.

With such arrangement, since timing, at which fitting at the respective fit portions begins, and timing, at which coupling of the contact coupling portions for electric connection begins, which fitting and coupling produce loads when the cartridge 1 is mounted in the main body 100, are staggered, a burden when mounting is performed by a user is reduced.

In particular, fitting of the second support 201 begins after fitting of the first support 200 is started. Thereafter, coupling of the high voltage contact 71 and the contact pin 95 provided on a side of the main body 100 to serve as an electricity supply portion is preferably made.

Thus it is possible to preceedingly perform positioning of a central axis of the photosensitive drum 2, which is most important for image quality and constitutes a reference for positioning the cartridge 1 in the main body 100. Thereafter, the photosensitive drum 2 is positioned in the direction of rotation, after which coupling of the high voltage contact 71 and the contact pin 95 is made. Accordingly, since coupling of the high voltage contact 71 and the contact pin 95 is made in a state in which positioning has been effected, it is possible to prevent excessive loads from being imposed on the high voltage contact 71 and the contact pin 95. Therefore, deformation and scarring of the high voltage contact 71 and the contact pin 95 can be prevented when the cartridge 1 is mounted in the main body 100, and failure in electric connection can be prevented.

Also, with the embodiment, the first support 200 and the second support 201 are made of the same member.

Also, with the embodiment, directions, in which the first support 200 undergoes fitting, in which the second support 201 undergoes fitting, and in which the high voltage contact 71 undergoes coupling, are made the same as a direction in which the process cartridge 1 is mounted in the main body 100.

Also, the image forming apparatus according to the embodiment, in which the process cartridges 1 are detachable and which forms images on a recording medium, comprises a mounting mechanism (mainly, the guide rail 60) for removably mounting the cartridge 1, and comprising, in an integral manner, the photosensitive drum 2, the charging means (the charging roller 3*a*, and so on) and the developing means (the developing sleeve 4*a*, and so on) in the embodiment, which serve as at least one process member contributing to the image forming process, and the high voltage contact 71 serving as an electricity supply contact member for supplying electricity to the charging means and the developing means, and the cartridge comprising the first support 200 constituting a first fit portion, by which an axial position of the photosensitive drum 2 relative to the body of the image forming apparatus is determined, and the second support 201 constituting a second fit portion, by which a position of the photosensitive drum 2 relative to the body of the image forming apparatus in a direction of rotation is determined, the first support member 63*a* serving as a first fit portion to be fitted into the first support 200, the second support member 63*b* serving as a second fit portion to be fitted into the second support 201, and the contact pin 95 for connection with the high voltage contact 71, and a timing, at which fitting of the first support 200 and the first support member 63*a* begins, a timing, at which fitting of the second support 201 and the second support member 63*b* begins, and a timing, at which coupling of the high voltage contact 71 and the contact pin 95 begins, respectively being staggered when the cartridge 1 is mounted in the main body 100.

With such arrangement, since timing, at which fitting at the respective fit portions begins, and timing, at which coupling of the contact coupling portions for electric connection begins, which fitting and coupling produce loads when the cartridge 1 is mounted in the main body 100, are staggered, a burden when mounting is performed by a user is reduced.

In particular, fitting of the second support 201 begins after fitting of the first support 200 is started. Thereafter, coupling of the high voltage contact 71 and the contact pin 95 provided on a side of the main body 100 to serve as an electricity supply portion is preferably made.

Thus it is possible to preceedingly perform positioning of a central axis of the photosensitive drum 2, which is most important for image quality and constitutes a reference for positioning the cartridge 1 in the main body 100. Thereafter, the photosensitive drum 2 is positioned in the direction of rotation, after which coupling of the high voltage contact 71 and the contact pin 95 is made. Accordingly, since coupling of the high voltage contact 71 and the contact pin 95 is made in a state, in which positioning has been effected, it is possible to prevent excessive loads from being imposed on the high voltage contact 71 and the contact pin 95, and to prevent failure in electric connection.

As described above, it is possible according to the embodiment to achieve reduction of a burden on a user when a process cartridge is mounted in an apparatus body.

As described above, it is possible according to the invention to improve properties of mounting when a process cartridge is mounted in a body of an electrophotographic image forming apparatus. Also, it is possible to reduce loads when a process cartridge is mounted in a body of an electrophotographic image forming apparatus. Further, it is possible to prevent deformation and breakage of an electric contact of a process cartridge when the process cartridge is mounted in a body of an electrophotographic image forming apparatus and to surely bring a cartridge contact portion and an electrode member of the body into contact with each other.

What is claimed is:

1. A process cartridge, detachably mountable to a main body of an electrophotographic image forming apparatus, the electrophotographic image forming apparatus having a main body guide, a first support member, a second support member, and a main body electrode member, the process cartridge comprising:

an electrophotographic photosensitive drum;

process means for performing a process on said electrophotographic photosensitive drum;

a cartridge guide configured and positioned to engage with the main body guide to guide said process cartridge in an axial direction of said electrophotographic photosensitive drum if said process cartridge is mounted in the main body of the apparatus;

a first fit portion provided on one end side of said electrophotographic photosensitive drum in the axial direction of said electrophotographic photosensitive drum to engage with the first support member in the axial direction, if said process cartridge is mounted in the body of the apparatus, to position said process cartridge;

a second fit portion provided on the one end side of said electrophotographic photosensitive drum in the axial direction of said electrophotographic photosensitive drum to begin fitting with the second support member in the axial direction, after starting of fitting of the first fit portion and the first support member when said process cartridge is mounted in the body of the apparatus, to position said process cartridge, and a cartridge electric contact provided on the one end side of said electrophotographic photosensitive drum to begin fitting with the main body electrode member, after starting of fitting of said second fit portion and the second support member when said process cartridge is mounted in the body of the apparatus, to receive voltage being supplied to said process means from the main body of the apparatus, and wherein the one end side of said electrophotographic photosensitive drum is a tip end side in a direction in which said process cartridge is mounted in the body of the apparatus.

2. The process cartridge according to claim 1, wherein said second fit portion restricts turning of said process cartridge about said first fit portion to position said process cartridge relative to the body of the apparatus.

3. The process cartridge according to claim 1, wherein said first fit portion and said second fit portion are formed integrally with each other.

4. The process cartridge according to claim 1, wherein said first fit portion includes a hole to be fitted onto a projection, which is the first support member.

5. The process cartridge according to claim 1, wherein said second fit portion includes a hole to be fitted onto a projection, which is the second support member.

6. The process cartridge according to claim 1, wherein said cartridge electric contact is provided in a recess provided on the one end side.

7. The process cartridge according to claim 1, wherein that position on said process cartridge, in which the first fit portion is provided, is one, in which said cartridge guide moves said process cartridge in a direction away from the main body guide when said first fit portion and the first support member fit each other, and that position, in which said second fit portion is provided, is one, in which said cartridge guide moves said process cartridge in a direction away from the body guide when said second fit portion and the second support member fit each other.

8. The process cartridge according to claim 7, wherein the direction away from the main body guide is obliquely upward in a state in which said process cartridge is mounted in the main body of the apparatus.

9. The process cartridge according to claim 1, wherein said process means comprises charging means for charging said electrophotographic photosensitive drum with electricity, and said cartridge electric contact fits on the main body charging electrode member provided on the main body of the apparatus to receive voltage being supplied to said charging means from the main body of the apparatus.

10. The process cartridge according to claim 1 or 9, wherein said process means comprises developing means formed on said electrophotographic photosensitive drum, and said cartridge electric contact fits on the main body developing electrode member provided on the main body of the apparatus to receive voltage being supplied to said developing means from the main body of the apparatus.

11. An electrophotographic image forming apparatus for forming an image on a recording medium, said image forming apparatus comprising (i) a main body guide;

(ii) a first support member;

(iii) a second support member;

(iv) a main body electrode member;

(v) mount means for detachably mounting a process cartridge comprising an electrophotographic photosensitive drum, process means for acting on the electrophotographic photosensitive drum, a cartridge guide configured and positioned to engage with said main body guide to guide the process cartridge in an axial direction of the electrophotographic photosensitive drum when the process cartridge is mounted in the main body of said apparatus, a first fit portion provided on one end side of the electrophotographic photosensitive drum in the axial direction to engage with said first support member in the axial direction, when the process cartridge is mounted in the main body of said apparatus, to position the process cartridge, a second fit portion provided on the one end side of the electrophotographic photosensitive drum in the axial direction to begin fitting with said second support member in the axial direction, after starting of fitting of the first fit portion and said first support member when the process cartridge is mounted in the main body of said apparatus, to position the process cartridge, and a cartridge electric contact provided on the one end side to begin fitting with said main body electrode member, after starting of fitting of the second fit portion and said second support member when the process cartridge is mounted in the main body of said apparatus, to receive voltage being supplied to the process means from the main body of said apparatus, the one end side being a tip end side in a direction, in which the process cartridge is mounted in the main body of said apparatus, and (vi) conveyance means for conveying the recording medium.

12. The electrophotographic image forming apparatus according to claim 11, wherein said second support member restricts turning of the process cartridge about said first support member to position the process cartridge relative to the main body of said apparatus.

13. The electrophotographic image forming apparatus according to claim 11, wherein said first support member includes a projection to be fitted into a hole of the first fit portion.

14. The electrophotographic image forming apparatus according to claim 11, wherein said second support member includes a projection to be fitted into a hole of the second fit portion.

15. The electrophotographic image forming apparatus according to claim 11, wherein that position on the main body of said apparatus, in which said first support member is provided, is one, in which the cartridge guide moves the process cartridge in a direction away from said main body guide when the first fit portion and said first support member fit each other, and that position, in which said second support member is provided, is one, in which the cartridge guide moves the process cartridge in a direction away from said main body guide when the second fit portion and said second support member fit each other.

* * * * *

UNITED STATES PATENT AND TRADEMARK OFFICE

CERTIFICATE OF CORRECTION

PATENT NO. : 6,954,601 B2
APPLICATION NO. : 10/671521
DATED : October 11, 2005
INVENTOR(S) : Atsushi Numagami et al.

It is certified that error appears in the above-identified patent and that said Letters Patent is hereby corrected as shown below:

COLUMN 2
Line 39, "provide a" should read --provide an--.

COLUMN 3
Line 40, "below to" should read --to below--.

COLUMN 4
Line 60, "below to" should read --to below--.

COLUMN 6
Line 25, "SnO2" should read --$SnO_2$--.

COLUMN 8
Line 45, "4al" should read --4a1--.
Line 60, "carrier." should read --carrier).--.

COLUMN 11
Line 32, "driven-to" should read --driven to--.

COLUMN 17
Line 40, "comprising" should read --comprising:--.

Signed and Sealed this

Third Day of October, 2006

JON W. DUDAS
*Director of the United States Patent and Trademark Office*

UNITED STATES PATENT AND TRADEMARK OFFICE

CERTIFICATE OF CORRECTION

PATENT NO. : 6,954,601 B2 
APPLICATION NO. : 10/671521
DATED : October 11, 2005
INVENTOR(S) : Atushi Numagami et al.

It is certified that error appears in the above-identified patent and that said Letters Patent is hereby corrected as shown below:

On the Title page, and item 45

[*] Notice: Subject to any disclaimer, the term of this patent is extended or adjusted under 35 USC 154(b) by (0) days Delete the phase "by 0" and insert -- by 30 days--

Signed and Sealed this

Nineteenth Day of December, 2006

JON W. DUDAS
*Director of the United States Patent and Trademark Office*